US011173995B1

(12) United States Patent
Fergus et al.

(10) Patent No.: US 11,173,995 B1
(45) Date of Patent: Nov. 16, 2021

(54) SYSTEMS AND METHODS FOR PREVENTING AERATION IN POWER STEERING SYSTEMS FOR MARINE PROPULSION DEVICES

(71) Applicant: Brunswick Corporation, Mettawa, IL (US)

(72) Inventors: Ryan A. Fergus, Neenah, WI (US); Travis C. Malouf, Germantown, WI (US); Justin K. Martin, Germantown, WI (US)

(73) Assignee: Brunswick Corporation, Mettaawa, IL (US)

( * ) Notice: Subject to any disclaimer, the term of this patent is extended or adjusted under 35 U.S.C. 154(b) by 181 days.

(21) Appl. No.: 16/713,590

(22) Filed: Dec. 13, 2019

(51) Int. Cl.
*B63H 20/10* (2006.01)
*B63H 20/12* (2006.01)
*B63H 20/32* (2006.01)

(52) U.S. Cl.
CPC ..... *B63H 20/10* (2013.01); *B63H 20/12* (2013.01); *B63H 20/32* (2013.01)

(58) Field of Classification Search
CPC ..... B63H 20/10; B63H 20/12; B63H 20/32
See application file for complete search history.

(56) References Cited

U.S. PATENT DOCUMENTS 5,392,690 A 2/1995 Hundertmark
5,505,641 A * 4/1996 Onoue ..... B63H 25/30 440/61 R
5,509,369 A * 4/1996 Ford ..... B63H 21/265 114/150
6,113,444 A 9/2000 Ritger
6,273,771 B1 8/2001 Buckley et al.
6,402,577 B1 6/2002 Treinen et al.
6,821,168 B1 11/2004 Fisher et al.
7,255,616 B1 8/2007 Caldwell
7,699,674 B1 4/2010 Wald et al.
8,046,122 B1 10/2011 Barta et al.
9,849,957 B1 12/2017 Grahl et al.
9,944,385 B2 4/2018 Lee et al.
10,472,038 B1 11/2019 Walgren et al.
2006/0278152 A1* 12/2006 Nickerson ..... B63H 25/36 114/144 R

* cited by examiner

*Primary Examiner* — Stephen P Avila
(74) *Attorney, Agent, or Firm* — Andrus Intellectual Property Law, LLP

(57) ABSTRACT

A steering system for a trimmable outboard motor. The steering system includes a hydraulic steering device that upon actuation changes a steering angle of the outboard motor. A pump communicates a hydraulic fluid with the hydraulic actuator to cause actuation thereof, where the pump operates at a pump speed, and where the pump speed impacts a change rate for the hydraulic steering device changing the steering angle. A reservoir is fluidly coupled to the pump and configured to retain the hydraulic fluid. A tilt sensor detects a trim angle of the outboard motor. A control system is operatively coupled with the pump and receives requests for changing the steering angle. The control system controls the pump speed of the pump based at least in part on the trim angle of the outboard motor.

20 Claims, 5 Drawing Sheets

SYSTEMS AND METHODS FOR PREVENTING AERATION IN POWER STEERING SYSTEMS FOR MARINE PROPULSION DEVICES

FIELD

The present disclosure generally relates to systems and methods for preventing aeration in power steering systems for outboard motors, and more particularly to systems and methods for preventing aeration in power steering systems for outboard motors, particularly by controlling pump speed for the steering system as a function of trim angle.

BACKGROUND

The following U.S. Patents provide background information and are incorporated by reference in entirety.

U.S. Pat. No. 6,113,444 discloses a rotary actuator used to steer a watercraft with an outboard motor. First and second brackets are attached to the outboard motor and the transom of the watercraft, respectively. The rotary actuator can be a hydraulic rotary actuator and either the rotor portion or stator portion of the rotary actuator can be attached to the outboard motor with the other portion being attached to the transom. A hydraulic pump is used to provide pressurized fluid to the actuator and a valve is used to selectively direct the pressurized fluid to one of two ports in the rotary actuator to select the directional rotation and speed between the stator portion and the rotor portion.

U.S. Pat. No. 6,273,771 discloses a control system for a marine vessel that incorporates a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Pat. No. 7,699,674 discloses a steering mechanism that connects the shaft of an actuator with a piston rod of a hydraulic cylinder and provides a spool valve in which the spool valve housing is attached to the hydraulic cylinder and the shaft of the actuator extends through a cylindrical opening in a spool of the spool valve. The connector is connectable to a steering arm of a marine propulsion device and the spool valve housing is connectable to a transom of a marine vessel.

U.S. Pat. No. 8,046,122 discloses a control system for a hydraulic steering cylinder that utilizes a supply valve and a drain valve. The supply valve is configured to supply pressurized hydraulic fluid from a pump to either of two cavities defined by the position of a piston within the hydraulic cylinder. A drain valve is configured to control the flow of hydraulic fluid away from the cavities within the hydraulic cylinder. The supply valve and the drain valve are both proportional valves in a preferred embodiment of the present invention in order to allow accurate and controlled movement of a steering device in response to movement of a steering wheel of a marine vessel.

U.S. Pat. No. 10,472,038 discloses an outboard motor for propelling a marine vessel in water, which can be trimmed about a trim axis into and between a raised position in which the outboard motor is fully trimmed up out of the water and a lowered position in which the outboard motor is fully trimmed down into the water. The outboard motor has a hydraulic steering actuator for steering the outboard motor about steering axis and a reservoir mounted on the outboard motor and containing hydraulic fluid for the hydraulic steering actuator. A vent opening vents the reservoir to atmosphere and is located on top of the reservoir and closer to the back of the outboard motor than the front of the outboard motor so that the vent opening does not become covered by the hydraulic fluid when the outboard motor is trimmed into and out of the raised and lowered positions.

Additional background relating to the presently disclosed systems and methods can also be found in U.S. Pat. Nos. 5,392,690, 6,402,577, 6,821,168, 7,255,616, and 9,849,957.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One embodiment of the present disclosure generally relates to a steering system for a trimmable outboard motor. The steering system includes a hydraulic steering device that upon actuation changes a steering angle of the outboard motor. A pump communicates a hydraulic fluid with the hydraulic actuator to cause actuation thereof, where the pump operates at a pump speed, and where the pump speed impacts a change rate for the hydraulic steering device changing the steering angle. A reservoir is fluidly coupled to the pump and configured to retain the hydraulic fluid. A tilt sensor detects a trim angle of the outboard motor. A control system is operatively coupled with the pump and receives requests for changing the steering angle. The control system controls the pump speed of the pump based at least in part on the trim angle of the outboard motor.

Another embodiment generally relates to a method for steering a trimmable outboard motor using a hydraulic steering device with a pump fluidly coupled thereto. The method includes receiving a steering request to change a steering angle of the outboard motor. The method further includes detecting with a tilt sensor a trim angle of the outboard motor. The method further includes controlling the pump with a control system, where the pump actuates the hydraulic steering device to change the steering angle of the outboard motor by communicating hydraulic fluid between a reservoir and the hydraulic steering device. The control system operates the pump at a pump speed based at least in part on the trim angle detected by the tilt sensor. The pump speed impacts a change rate of the hydraulic steering device changing the steering angle.

Various other features, objects and advantages of the disclosure will be made apparent from the following description taken together with the drawings.

BRIEF DESCRIPTION OF THE DRAWINGS

The present disclosure is described with reference to the following Figures.

DETAILED DISCLOSURE

The present disclosure generally relates to power steering systems for marine propulsion devices. In steering systems presently known in the art, the pump and other components of a steering system (e.g., the reservoir) are located on the marine vessel. The inventors have identified new problems arising with steering systems in which the pump system is mounted on the moveable portion of a marine propulsion device, such as an outboard motor, whereby the steering system is consequently tilted in conjunction with adjustments to the trim angle of the marine propulsion device. In particular, the inventors have identified a problem with the aeration of the fluid pumped by the pump as a result of positioning the pump being angled during operation. An exemplary outboard motor in which the present disclosure may apply is described in U.S. Pat. No. 10,472,038.

Specifically, the inventors have identified that pumps work best when there is a sufficient body or volume of fluid above the pump during operation. When there is an insufficient body of fluid present above the pump, aeration of the fluid occurs during operation of the pump. This aeration is exacerbated by steeper angles of the pump system (due to a consequent reduction in both the volume and positive head of the fluid remaining above the pump inlet), and also by operating the pump at higher pump speeds. Through experimentation and development, the inventors have identified that once the fluid has been aerated, it often takes a long period of time before the fluid returns to a normal, non-aerated state. During this time, steering performance suffers, which remains even when the pump is no longer angled since the fluid being pumped is already aerated. As will become apparent, the presently disclosed systems and methods minimize the risk of aeration while nonetheless providing for operation of the steering system throughout the full range of trim angles.

Figure 1:
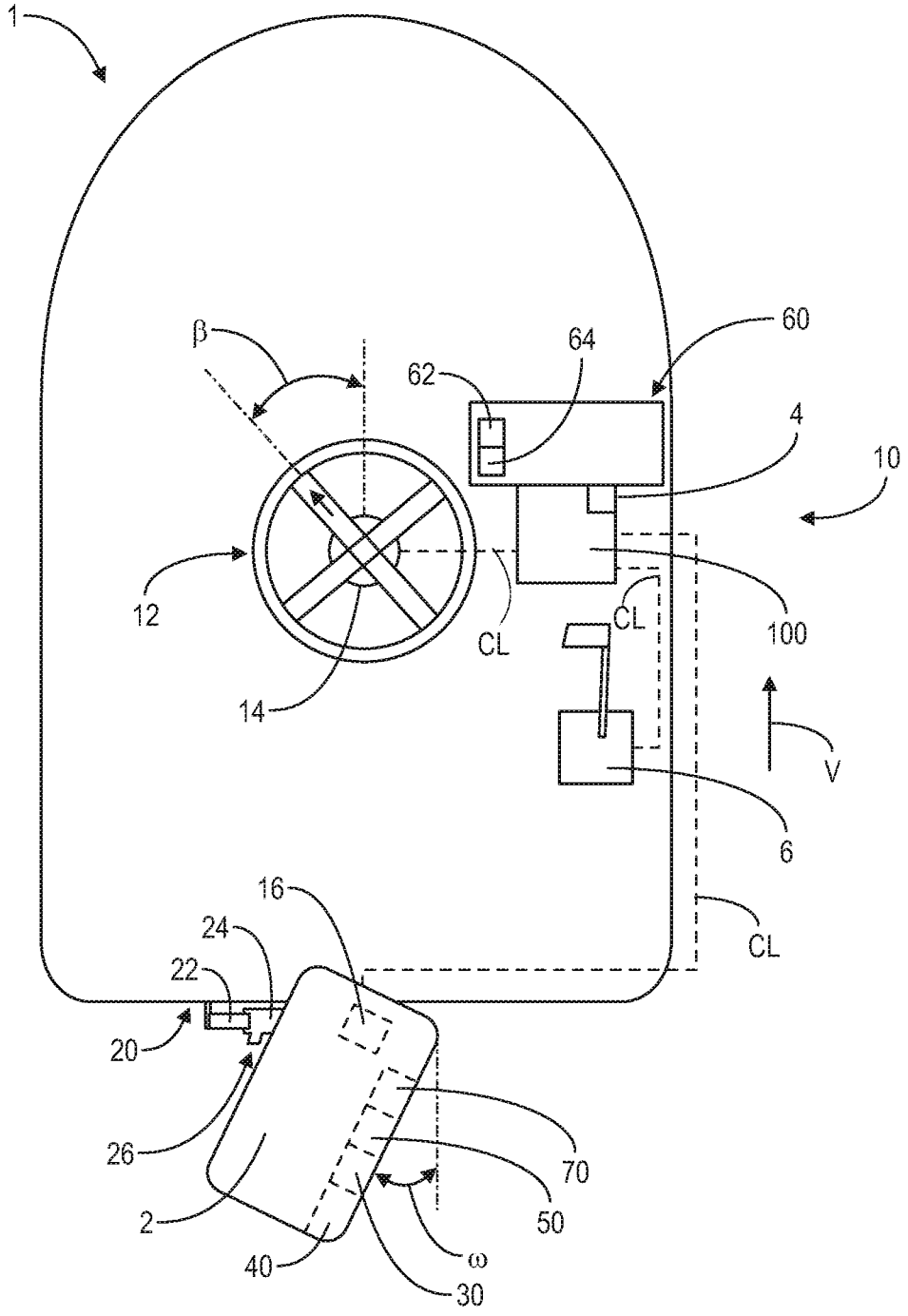
FIG. 1 is a top view representation of a marine vessel incorporating a steering system according to the present disclosure.

FIG. 1 depicts an exemplary embodiment of a marine vessel 1 configured to be propelled through the water by an outboard motor 2 and steerable by a steering system 10 according to the present disclosure. In particular, the steering system 10 is configured for operation with a trimmable outboard motor 2, which as will be discussed is nonetheless configured to prevent the risk of aeration discussed above.

The outboard motor 2 is controllable by a throttle controller 6 to propel the marine vessel 1 through the water at a velocity V in the manner known in the art. In the embodiment shown, the throttle controller 6 is operatively coupled to a control system 100, such as an engine control unit (ECU), and/or a central controller such as a helm control unit (HCU) or command control module (CCM), which may be position on the marine vessel 1 and/or the outboard motor 2. An exemplary control system 100 is described below and provided in FIG. 4. It will be recognized that the control system 100 presently shown in merely exemplary, and may be relocated or divided among multiple separate devices provided in connection with each other.

A velocity sensor 4 is also operatively coupled with the control system 100 for detecting the velocity V of the marine vessel 1. The marine vessel 1 is steerable by a steering input device 12, for example a steering wheel as shown in FIG. 1. The steering input device 12 is rotatable about an axis to various steering input angles β relative to a straight ahead positon, which is detectable by a steering input angle sensor 14 also operatively connected to the control system 100. The steering system 10 consequently steers the outboard motor 2 according to the reading of the steering input angle sensor 14.

The steering system 10 of the present embodiment includes a hydraulic steering device 20 that upon actuation changes a steering angle ω of the outboard motor 2 relative to the straight ahead position (shown vertically). This steering angle ω is detected by a steering angle sensor 16 in a manner similar to the steering input angle sensor 14 that detects the steering input angle β of the steering input device 12 as discussed above.

In the example shown, the hydraulic steering device 20 includes a rod 22 configured to be extended and retracted from and within a cylinder 24 via pressure differentials between a first port 26 and a second port (not shown) in a manner known in the art. However, other examples of hydraulic steering devices 20 known in the art include cylinder rack and pinion designs, for example.

A pump 30 communicates hydraulic fluid HF (see FIG. 2) with the hydraulic steering device 20 to cause actuation thereof, which as discussed above is controlled at least in part by the steering input angle sensor 14 inputs to the control system 100. The pump 30 is operated at a pump speed, which impacts the speed of actuation or rate of change for the hydraulic steering device 20 (e.g. the rate at which the rod 22 extends or retracts from all within the cylinder 24). It will be recognized that this in turn also impacting the rate of change of the outboard steering angle ω. In the embodiment shown, the pump 30 comprises a motor 31 that rotates a positive displacement rotating group 32 in a conventional manner. Exemplary positive displacement pumps as the pump 30 include gerotors, gear pumps, piston pumps. However, it will be recognized that the present disclosure relates to any type of pump 30, including impeller pumps, for example.

Figure 2:
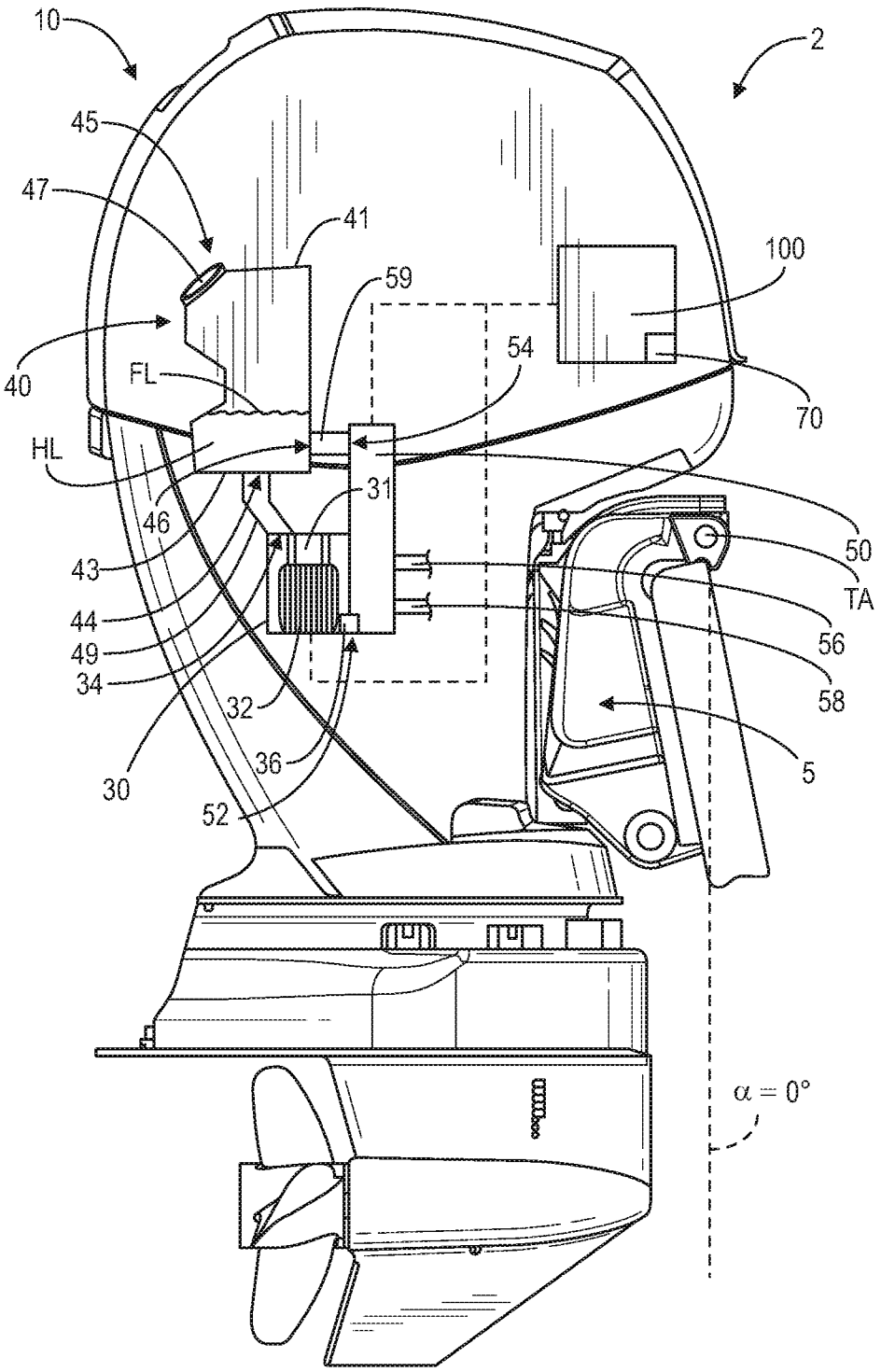
FIG. 2 is a side view of an outboard motor incorporating a steering system according to the present disclosure shown at a zero degree tilt angle.
Figure 3:
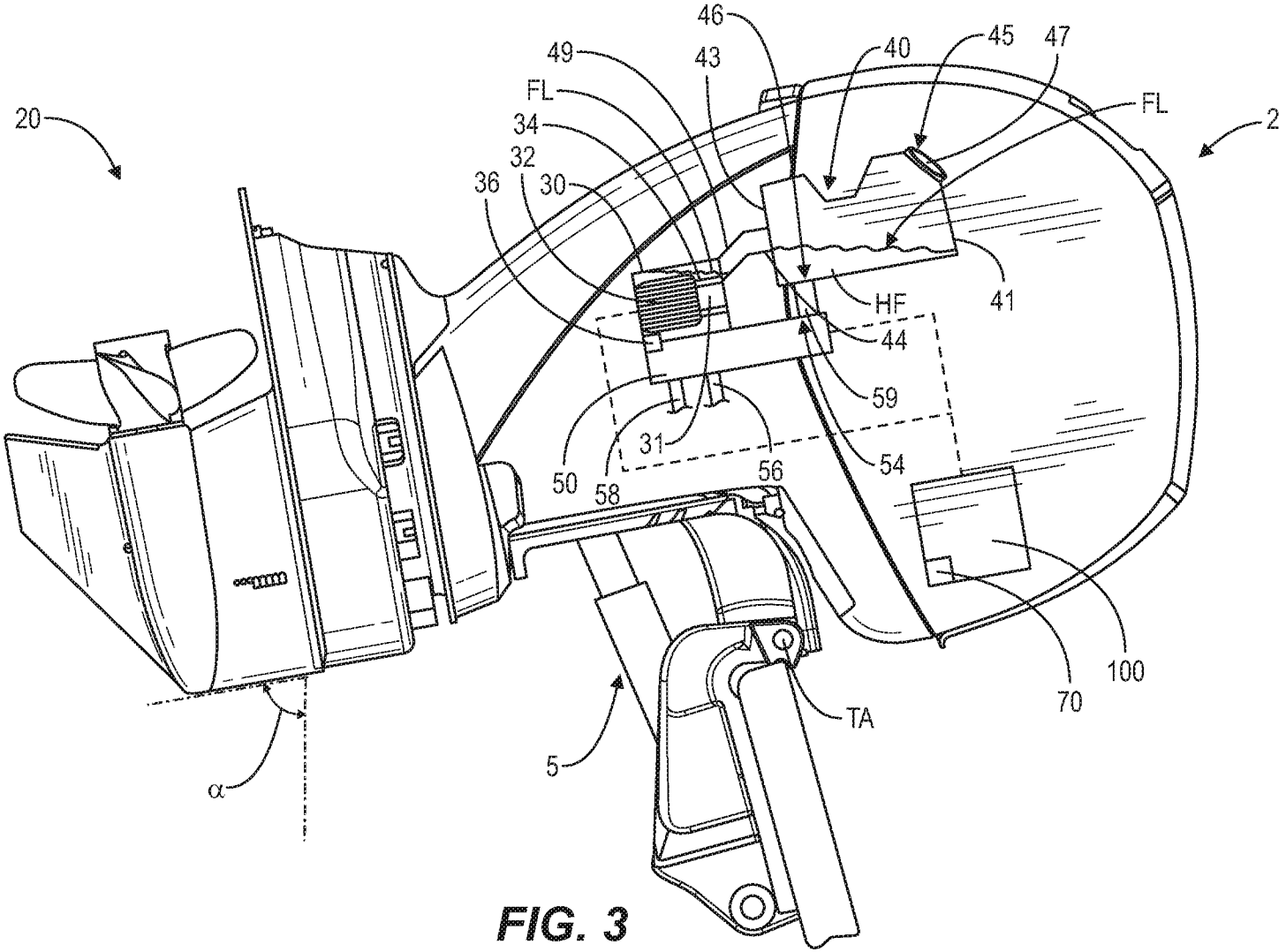
FIG. 3 is a side view of an outboard motor incorporating a steering system according to the present disclosure shown at a different trim angle.

As best shown in FIGS. 2 and 3, a reservoir 40 is fluidly coupled to the pump 30 and configured to retain the hydraulic fluid HF therein. This hydraulic fluid HF may be any conventional power steering fluid as known in the art, for example. In the embodiment shown, the reservoir 40 has a top 41 and a bottom 43 and is fillable via a fill port 45 near the top 41 by removal of a cap 47. The reservoir 40 has a supply port 44 that in this example is provided at the bottom 43 of the reservoir 40, which is coupled to a conduit 49 for communicating the hydraulic fluid HF from the reservoir 40 to the pump 30, and specifically via a reservoir port 34 thereon. FIG. 2 further shows a fill level FL of the hydraulic fluid HF within the reservoir 40 (the pump 30 is presently shown to be entirely full). The reservoir 40 further includes a return port 46 for receiving hydraulic fluid HF returning via a conduit 59 from a valve 50 operatively connected to the hydraulic steering device 20, which is discussed further below.

Additional information is now providing for the exemplary pump 30 shown in FIG. 2. A pump of positive displacement category (typically gear, vane or axial piston type) in either fixed or variable displacement configuration would support the claim of invention. In the example shown, the pump 30 operates by rotating a gear set 32 via a motor 31, which in this example the pump speed is controlled by a control system 100 previously discussed. Operation of the pump 30 forces hydraulic fluid HF received from the reservoir 40 out through a valve port 36, which is fluidly coupled to a valve 50.

In the example shown, the valve 50 has a pump port 52 for receiving hydraulic fluid HF from the pump 30, as well as a reservoir port 54 for selectively returning hydraulic fluid HF back to the reservoir 40 via the conduit 59. Certain examples, the valve 50 is a proportional directional control valve controllable by a control system, such as the control system 100 discussed above, to control the flow of hydraulic fluid HF through the pump port 52 and the reservoir port 54, as well as through a first port 56 and second port 58. In the example shown, the first port 56 of the valve 50 is fluidly coupled to the first port 26 of the hydraulic steering device 20, and likewise the second port 58 of the valve to the second port 28 of the hydraulic steering device 20, to selectively actuate the hydraulic steering device 20 to thereby steer the outboard motor 2 in either direction.

With continued reference to FIG. 2, the outboard motor 2 is also provided with a trim system 5 for adjusting a trim angle α between the outboard motor 2 and the vertical plane. The outboard motor 2 is shown in FIG. 2 at a trim angle α of zero degrees. Returning to FIG. 1, the outboard motor 2 is further outfitted with a trim sensor 70 that is operatively coupled to the control system 100 and configured to detect the trim angle α of the outboard motor 2 throughout adjustment of the trim system 5. In the example shown, an operator controls the trim angle α through use of a trim up actuator 62 and a trim down actuator 64 provided within the control panel 60, which may be momentary buttons actuated in a manner presently known in the art. In this example, the control system 100 receives inputs from the trim up actuator 62 and trim down actuator 64 for operating the trim system 5 to adjust the trim angle of the outboard motor 2 accordingly.

FIG. 3 depicts the outboard motor 2 of FIG. 2, now adjusted via the trim system 5 to have a different trim angle α, for example approximately 80 degrees. As shown, when the outboard motor 2 is adjusted to have a trim angle α of approximately 80 degrees, the fill level FL of hydraulic fluid HF within the reservoir 40, and likewise within the pump 30, provide that little volume remains above the pump inlet 32 of the pump 30 and positive head is reduced, thereby creating the risk for aeration as discussed above. However, the inventors have identified that this risk for aeration is directly correlated not only to the amount of fluid provided above the pump 30, but also by the pump speed of operating the pump 30.

Figure 5:
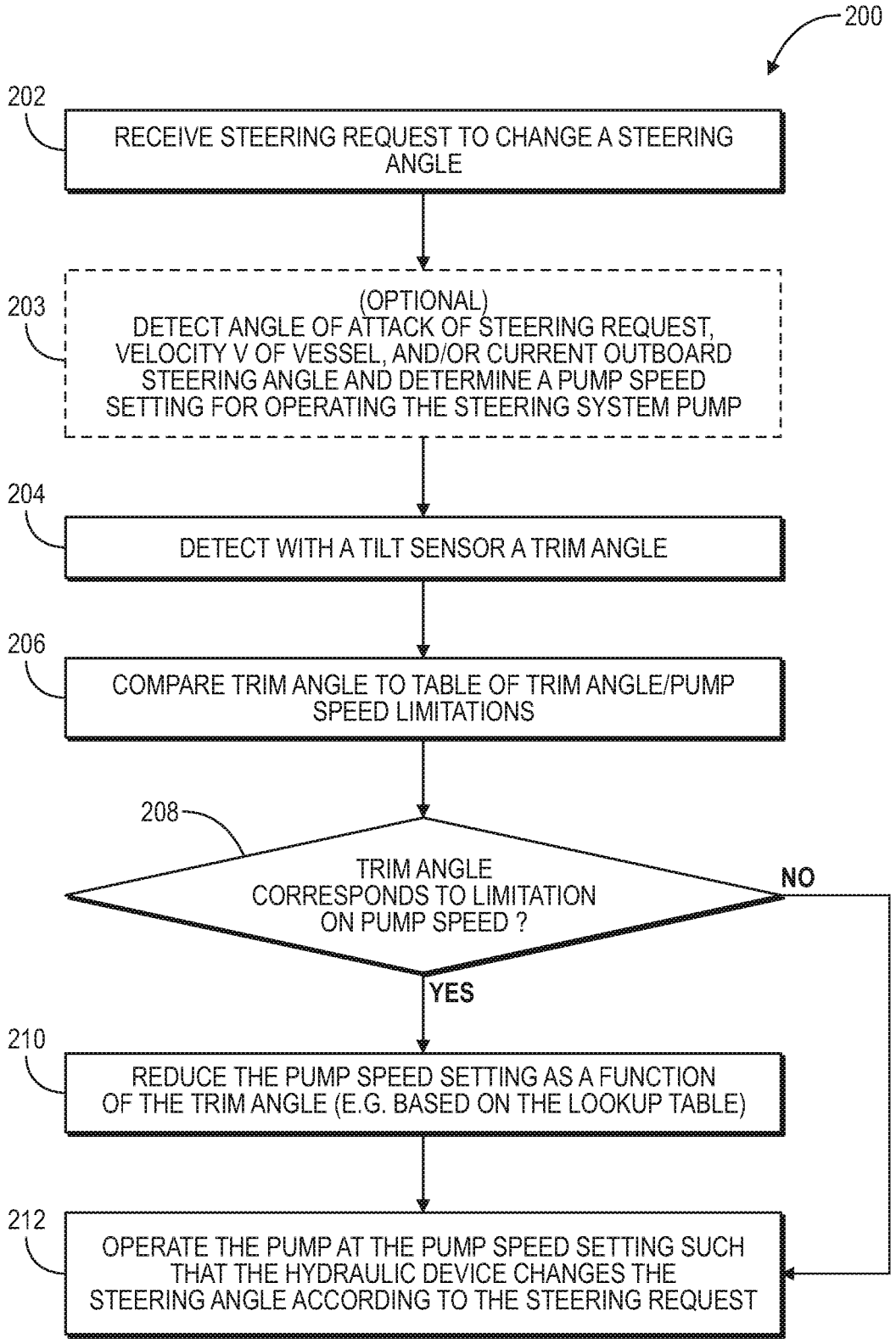
FIG. 5 is an exemplary process flow for controlling a steering system according to the present disclosure.

Accordingly, an exemplary process 200 for operating the steering system 10 to prevent aeration and ensure proper functionality of the steering system 10 is provided in FIG. 5. The process 200 begins with receiving a steering request in step 202 to change an outboard steering angle ω for the outboard motor 2, such as via the steering input device 12 shown in FIG. 1. In certain embodiments, shown in here at step 203, the process 200 includes detecting or calculating an angle of attack for the steering request (e.g., an acceleration provided by the steering input device 12 in rotating to the steering input angle β), a velocity via the marine vessel 1, and/or the current outboard steering angle ω to determine an initial pump speed setting for operating the pump 30 of the steering system 10.

In step 204, a trim angle α is detected by a tilt sensor 70, which is then used in step 206 to be compared (such as within a control system 100) to a table of trim angles α and corresponding pump speed caps. In further embodiments, a relationship between trim angle α and pump speed (or caps thereto) may be determined using an algorithm or other mechanism. If the trim angle α detected by the tilt sensor 70 in step 204 as compared in step 206 is determined to correspond to a cap on pump speed in step 208, the pump speed is reduced in step 210 as a function of this trim angle α, based on the lookup table value. In other words, the look up table provides for maximum pump speeds for the pump 30 as a function of trim angle α. However, the actual pump speed may or may not be impacted by this cap depending on other factors, such as the optional determinations of angle of attack, velocity V, and current outboard steering angle ω from step 203, for example.

In step 212, the pump 30 is operated at the pump speed setting provided in step 210 such that the hydraulic steering device 20 changes the outboard steering angle ω according to the steering request from the steering input device 12. If alternatively it is determined in step 208 that the trim angle α detected by the trim sensor 70 does not correspond to a cap on pump speed, then the pump 30 is permitted to operate at the original pump speed setting, such as that determined at step 203.

In certain embodiments, the look up table for caps on pump speeds as a function of tilt angle α discussed above may be divided into multiple zones. For example, a service mode may allow some level of operation for the pump 30 even at an extreme tilt angle α (e.g., at a very low pump speed), which may not be permitted in a normal or safe pump operation mode in which the pump 30 is entirely disabled. Different methods for selecting and alternating between these zones or operating modes include mechanical switches on the outboard motor 2, or within the control panel 60 of the marine vessel 1, for example. Likewise, diagnostic software tools, such as Mercury Marine's G3 software used to perform service functions at dealers, may be used to configure the availability and particular parameters of zones or operating modes for the outboard motor 2.

It will be recognized that the look up table may also have any number of discrete cap values for pump speed based on tilt angle α. For example, a different a pump speed maximum or cap (as a function of 100% maximum operation) may be provided for each degree of tilt angle α, or as a step function. In certain embodiments, these step functions include no cap to the pump speed of the pump 30 when the tilt angle α is below 30%, a 25% pump speed cap (in other words, no more than 25% of the maximum or nominal pump speed of the pump 30) when the tilt angle α is greater than 60%, and a 50% pump speed cap for tilt angles α therebetween, for example.

In certain embodiments, a cap on the pump speed is retained for a predetermined duration even where the trim angle α of the outboard motor 2 would not otherwise require such a cap. This can ensure that any aeration that did occur within the hydraulic fluid HF is permitted to resolve itself before the pump 30 is allowed to resume full operation. Similarly, the steering system 10 may include a delay before any changes are made to the pump speed of the pump 30, which would preclude frequent changes to pump speed for transient trim angle α conditions. For example, if the trim angle α is right on the border of requiring a pump speed cap, the steering system 10 may wait 5 seconds before imposing such changes to the control of the pump 30, as bouncing of the marine vessel 1 and minor steering adjustments may cause the trim angle $\alpha$ to transition in and out of specific zones for control.

Figure 4:
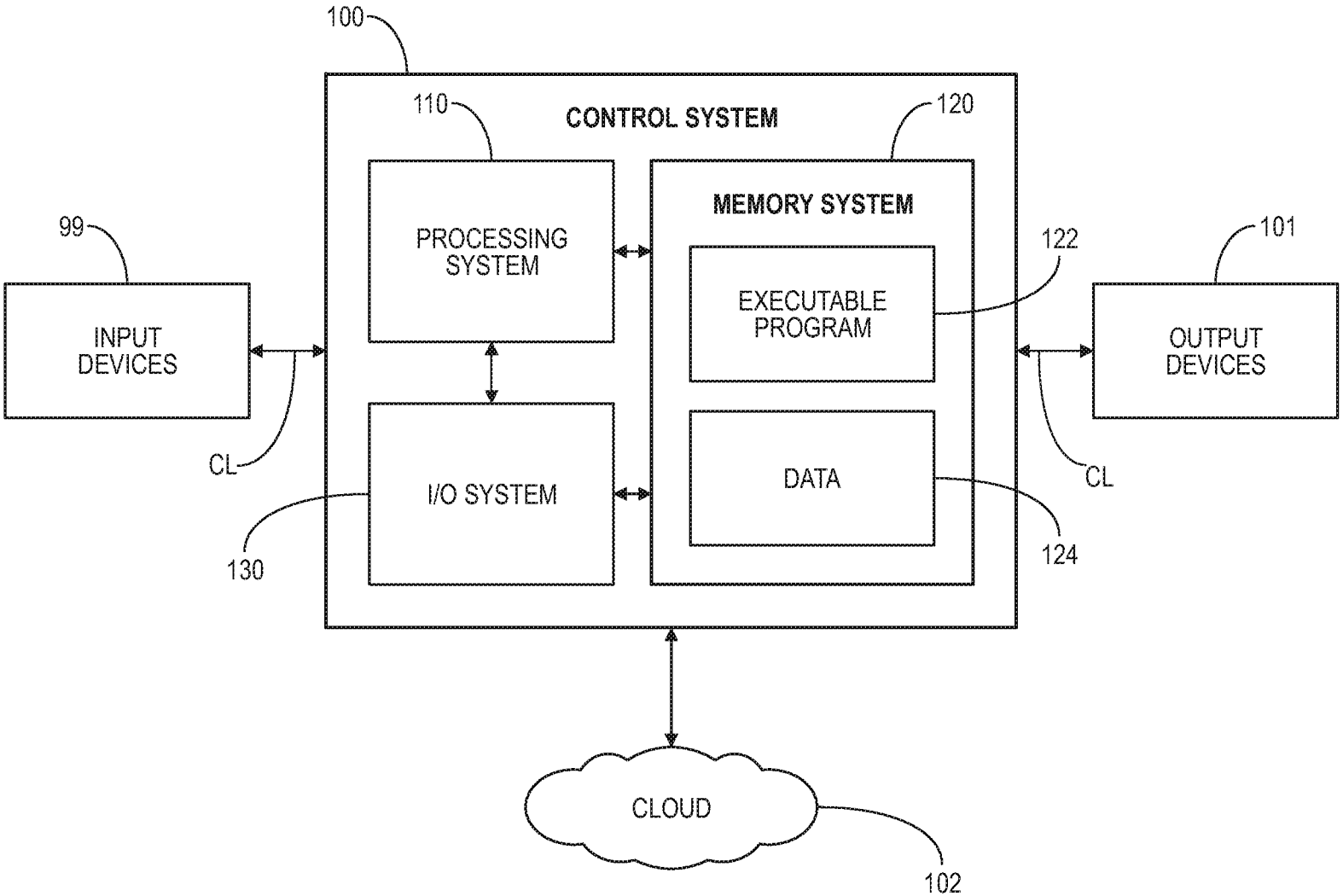
FIG. 4 is a schematic representation of the exemplary control system for operating a steering system according to the present disclosure.

An exemplary control systems 100 is shown in FIG. 4. As discussed above, a control system like the control system 100 of FIG. 4 may be provided within the outboard motor 2, within the marine vessel 1, or both. Certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices. The connections between functional and logical block components are merely exemplary, which may be direct or indirect, and may follow alternate pathways.

In certain examples, the control system 100 communicates with each of the one or more components of the steering system 10 via a communication link CL, which can be any wired or wireless link. The control system 100 is capable of receiving information and/or controlling one or more operational characteristics of the steering system 10 and its various sub-systems by sending and receiving control signals via the communication links CL. In one example, the communication link CL is a controller area network (CAN) bus; however, other types of links could be used. It will be recognized that the extent of connections and the communication links CL may in fact be one or more shared connections, or links, among some or all of the components in the steering system 10. Moreover, the communication link CL lines are meant only to demonstrate that the various control elements are capable of communicating with one another, and do not represent actual wiring connections between the various elements, nor do they represent the only paths of communication between the elements. Additionally, the steering system 10 may incorporate various types of communication devices and systems, and thus the illustrated communication links CL may in fact represent various different types of wireless and/or wired data communication systems.

The control system 100 may be a computing system that includes a processing system 110, memory system 120, and input/output (I/O) system 130 for communicating with other devices, such as input devices 99 and output devices 101, either of which may also or alternatively be stored in a cloud 102. The processing system 110 loads and executes an executable program 122 from the memory system 120, accesses data 124 stored within the memory system 120, and directs the steering system 10 to operate as described in further detail below.

The processing system 110 may be implemented as a single microprocessor or other circuitry, or be distributed across multiple processing devices or sub-systems that cooperate to execute the executable program 122 from the memory system 120. Non-limiting examples of the processing system include general purpose central processing units, application specific processors, and logic devices.

The memory system 120 may comprise any storage media readable by the processing system 110 and capable of storing the executable program 122 and/or data 124. The memory system 120 may be implemented as a single storage device, or be distributed across multiple storage devices or sub-systems that cooperate to store computer readable instructions, data structures, program modules, or other data. The memory system 120 may include volatile and/or non-volatile systems, and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A steering system for a trimmable outboard motor, the steering system comprising:

a hydraulic steering device that upon actuation changes a steering angle of the outboard motor;

a pump that communicates a hydraulic fluid with the hydraulic steering device to cause actuation thereof, wherein the pump operates at a pump speed, and wherein the pump speed impacts a change rate for the hydraulic steering device changing the steering angle;

a reservoir fluidly coupled to the pump and configured to retain the hydraulic fluid;

a tilt sensor that detects a trim angle of the outboard motor; and a control system operatively coupled with the pump, wherein the control system receives requests for changing the steering angle, and wherein the control system controls the pump speed of the pump based at least in part on the trim angle of the outboard motor.

2. The steering system according to claim 1, wherein the control system is configured to receive a steering request to change the steering angle, and wherein the control system also controls the pump speed based on the steering request.

3. The steering system according to claim 2, wherein the steering request includes an angle of attack, and wherein increasing the angle of attack increases the pump speed.

4. The steering system according to claim 1, further comprising a lookup table that includes the pump speed as a function of the trim angle, and wherein the control system controls the pump speed based on the lookup table.

5. The steering system according to claim 1, wherein the control system also controls the pump speed based on the steering angle.

6. The steering system according to claim 1, wherein the outboard motor causes a marine vessel to move at a velocity, and wherein the control system also controls the pump speed based on the velocity.

7. The steering system according to claim 1, wherein the hydraulic steering device is electrohydraulic.

8. The steering system according to claim 1, wherein the control system controls the pump speed to be at least 80% of an upper limit when the trim angle is zero degrees and less than 80% of the upper limit when the trim angle is at least 45 degrees.

9. The steering system according to claim 1, wherein the control system is configured to compare the trim angle to a maximum tilt angle, and wherein the control system controls the pump such that the pump is operable only when the trim angle is less than the maximum tilt angle.

10. The steering system according to claim 9, wherein the control system is also configured to compare the trim angle to a restriction trim angle that is less than the maximum trim angle, and wherein the control system controls the pump such that the pump speed is no more than a restricted speed when the trim angle is at least the restriction trim angle but below the maximum trim angle.

11. A method for steering a trimmable outboard motor using a hydraulic steering device with a pump fluidly coupled thereto, the method comprising:

receiving a steering request to change a steering angle of the outboard motor;

detecting with a tilt sensor a trim angle of the outboard motor; and controlling the pump with a control system, wherein the pump actuates the hydraulic steering device to change the steering angle of the outboard motor by communicating hydraulic fluid between a reservoir and the hydraulic steering device, and wherein the control system operates the pump at a pump speed based at least in part on the trim angle detected by the tilt sensor;

wherein the pump speed impacts a change rate of the hydraulic steering device changing the steering angle.

12. The method according to claim 11, wherein the control system also controls the pump speed based on the steering request.

13. The method according to claim 12, wherein the steering request includes an angle of attack, and wherein increasing the angle of attack increases the pump speed.

14. The method according to claim 11, further comprising providing a lookup table that includes the pump speed as a function of the trim angle, wherein the control system controls the pump speed based on the lookup table.

15. The method according to claim 11, wherein the control system also controls the pump speed based on the steering angle.

16. The method according to claim 11, wherein the outboard motor causes a marine vessel to move at a velocity, and wherein the control system also controls the pump speed based on the velocity.

17. The method according to claim 11, wherein the hydraulic steering device is electrohydraulic.

18. The method according to claim 11, wherein the control system controls the pump speed to be at least 80% of an upper limit when the trim angle is zero degrees and less than 80% of the upper limit when the trim angle is at least 45 degrees.

19. The method according to claim 11, wherein the control system compares the trim angle to a maximum tilt angle, and wherein the control system operates the pump only when the trim angle is less than the maximum tilt angle.

20. The method according to claim 19, wherein the control system also compares the trim angle to a restriction trim angle that is less than the maximum trim angle, and wherein the control system controls the pump such that the pump speed is no more than a restricted speed when the trim angle is at least the restriction trim angle but below the maximum trim angle.

* * * * *